US009256241B2

(12) United States Patent
Ogawa et al.

(10) Patent No.: US 9,256,241 B2
(45) Date of Patent: Feb. 9, 2016

(54) REFERENCE VOLTAGE GENERATING APPARATUS AND SWITCHING POWER APPARATUS

(71) Applicant: KABUSHIKI KAISHA TOSHIBA, Minato-ku (JP)

(72) Inventors: Taichi Ogawa, Inagi (JP); Takeshi Ueno, Kawasaki (JP); Shoji Ootaka, Yokohama (JP); Tetsuro Itakura, Nerima (JP); Takayuki Miyazaki, Setagaya (JP)

(73) Assignee: KABUSHIKI KAISHA TOSHIBA, Minato-ku (JP)

( * ) Notice: Subject to any disclaimer, the term of this patent is extended or adjusted under 35 U.S.C. 154(b) by 0 days.

(21) Appl. No.: 14/488,555

(22) Filed: Sep. 17, 2014

(65) Prior Publication Data

US 2015/0077177 A1 Mar. 19, 2015

(30) Foreign Application Priority Data

Sep. 19, 2013 (JP) ..... 2013-193910
Dec. 24, 2013 (JP) ..... 2013-265168

(51) Int. Cl.
*G05F 1/10* (2006.01)
*G05F 5/00* (2006.01)

(52) U.S. Cl.
CPC ..... *G05F 5/00* (2013.01)

(58) Field of Classification Search
CPC ..... G05F 1/46; G05F 1/461; G05F 5/00; H02M 3/06
See application file for complete search history.

(56) References Cited

U.S. PATENT DOCUMENTS 5,754,417 A * 5/1998 Nicollini ..... H02M 3/07 327/536
6,337,598 B1 1/2002 Ohno
6,956,429 B1 * 10/2005 Elbanhawy ..... G05F 1/575 327/541

FOREIGN PATENT DOCUMENTS

JP 3293584 B2 6/2002

* cited by examiner

*Primary Examiner* — Jeffrey Zweizig
(74) *Attorney, Agent, or Firm* — Oblon, McClelland, Maier & Neustadt, L.L.P.

(57) ABSTRACT

There is provided a reference voltage generating apparatus including: a reference voltage source, a voltage retaining circuit, a switch and a controller. The reference voltage source generates a reference voltage. The voltage retaining circuit includes a first element circuit and a second element circuit, and the voltage retaining circuit outputs a voltage of a connection node between a first terminal of the first element circuit and a second terminal of the second element circuit. The switch is connected between the connection node and the reference voltage source. The controller controls the reference voltage source and the switch. The first element circuit includes at least a resistance component and the first element circuit is supplied with a first voltage at a third terminal and the second element circuit includes a resistance component and a capacity component and the second element circuit is supplied with a second voltage at a fourth terminal.

20 Claims, 13 Drawing Sheets

REFERENCE VOLTAGE GENERATING APPARATUS AND SWITCHING POWER APPARATUS

CROSS-REFERENCE TO RELATED APPLICATIONS

This application is based upon and claims the benefit of priority from Japanese Patent Applications No. 2013-193910 filed on Sep. 19, 2013 and No. 2013-265168 filed on Dec. 24, 2013; the entire contents of which are incorporated herein by reference.

FIELD

Embodiments described herein relate to a reference voltage generating apparatus and a switching power apparatus.

BACKGROUND

A reference voltage generating apparatus to restrain power consumption is known as a conventional technology. This reference voltage generating apparatus includes an operational amplifier. The reference voltage generating apparatus includes an intermittent operation means to cause this operational amplifier to operate only for a predetermined period of time when the reference voltage generating apparatus normally operates. A switchover of the operation is controlled by a digital signal. The digital signal is switched ON/OFF by an oscillator. When the digital signal is switched ON, a capacitor is charged with electric charges. When the digital signal is switched OFF, the operational amplifier for supplying a reference voltage stops, and instead the capacitor continues to supply the reference voltage.

However, in the conventional technology described above, the voltage retained by the capacitor is settled eventually to a ground potential by a parasitic resistance of the capacitor. Hence, there is a necessity for charging the capacitor with the reference voltage at every interval of a fixed period of time, and an intermittent period (OFF-period) cannot be extended, thereby disabling the power consumption from decreasing.

DETAILED DESCRIPTION

There is provided a reference voltage generating apparatus including: a reference voltage source, a voltage retaining circuit, a switch and a controller.

The reference voltage source generates a reference voltage.

The voltage retaining circuit includes a first element circuit and a second element circuit, and the voltage retaining circuit outputs a voltage of a connection node between a first terminal of the first element circuit and a second terminal of the second element circuit.

The switch is connected between the connection node and the reference voltage source.

The controller controls the reference voltage source and the switch.

The first element circuit includes at least a resistance component and the first element circuit is supplied with a first voltage at a third terminal and the second element circuit includes a resistance component and a capacity component and the second element circuit is supplied with a second voltage at a fourth terminal.

In-depth descriptions of embodiments will hereinafter be made with reference to the drawings.

(First Embodiment)

Figure 1:
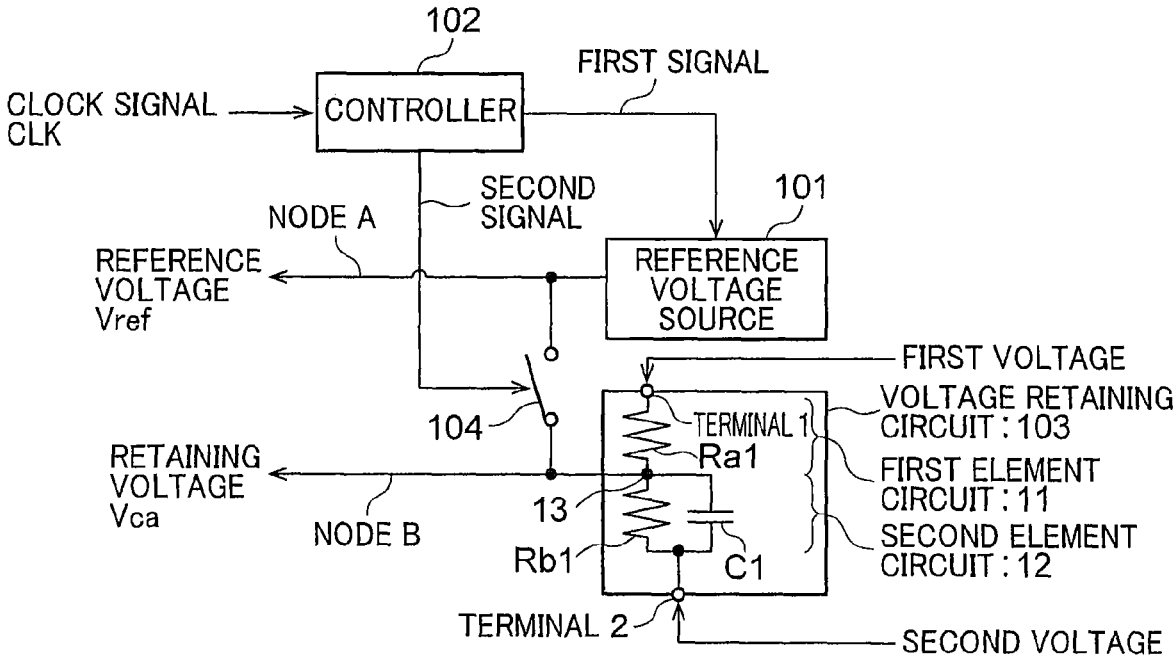
FIG. 1 is a diagram of a circuit configuration of a reference voltage generating apparatus according to a first embodiment.

FIG. 1 is a diagram of a circuit configuration of a reference voltage generating apparatus according to a first embodiment.

The reference voltage generating apparatus in FIG. 1 includes a reference voltage source 101, a controller 102, a voltage retaining circuit 103 and a switch 104.

The reference voltage source 101 is a power source having a small degree of dependency on a process, power and a temperature, and supplies a reference voltage Vref.

The controller 102 controls the reference voltage source 101 and the switch 104. A clock signal CLK is inputted to the controller 102. The controller 102, while receiving the input of the clock signal CLK, outputs a first signal to the reference voltage source 101. The first signal is switched ON at, e.g., a fixed cycle and switched OFF after duration of an ON-state for a fixed period of time. The reference voltage source 101 continues to output the reference voltage Vref to a node A while the first signal is kept ON.

The voltage retaining circuit 103 has a first element circuit 11 including at least a resistance component and supplied with a first voltage at its terminal 1 as one terminal thereof. The voltage retaining circuit 103 has also a second element circuit 12 including the resistance component and a capacity component and supplied with a second voltage at its terminal 2 as one terminal thereof. The voltage retaining circuit 103 outputs a voltage of a connection node 13 between the other terminal of the first element circuit 11 and the other terminal of the second element circuit 12.

More specifically, the voltage retaining circuit 103 has the terminal 1 receiving the input of the first voltage and the terminal 2 receiving the input of the second voltage. Resistance components Ra1, Rb1 are interposed in series between the terminal 1 and the terminal 2. A voltage Vca is generated by divided voltages of the first and second voltages and is output to a node B. A capacitor C1 is connected in parallel with the resistance component Rb1 and retains the voltage Vca. This voltage Vca is an output voltage of the voltage retaining circuit 103 and will hereinafter be called a retaining voltage.

Herein, the resistance components Ra1, Rb1 are exemplified such as a parasitic resistance of the capacitor and a resistance between a drain and a source of an off-transistor. The resistance components Ra1, Rb1 are as very large as several G-TΩ. In an illustrated example, the resistance component Rb1 is the parasitic resistance of the capacitor C1. The resistance component Ra1 is the resistance between the drain and the source of the off-transistor by way of one example. However, the capacitor may be disposed in the first element circuit, and the resistance component Ra1 may be set as the resistance component of the capacitor.

The node A is connected to the node B via the switch 104, and the switch 104 is switched ON/OFF by the controller 102. The controller 102 outputs the second signal, thereby controlling the ON/OFF state of the switch 104. To give one example, the switch 104 is closed (ON) when the second signal is ON but is opened (OFF) when the second signal is OFF.

The reference voltage source 101 outputs the reference voltage Vref upon receiving the ON-signal from the controller 102, the switch 104 is switched ON by the controller 102 while the reference voltage source 101 outputs the reference voltage, and the capacitor C1 of the voltage retaining circuit 103 is charged with the reference voltage Vref. After being charged, the controller 102 switches OFF the switch 104 and thereafter switches OFF the reference voltage source 101. The reference voltage Vref is thereby retained in the capacitor C1 of the voltage retaining circuit 103.

The resistance components Ra1, Rb1 of the voltage retaining circuit 103 are set at such a resistance voltage division ratio that the retaining voltage Vca is equalized to the reference voltage Vref. The retaining voltage Vca is settled to a DC voltage determined by a voltage division resistance.

However, the parasitic resistances (resistance component Rb1 etc.) of the capacitor are parameters that cannot be strictly designed, and hence the voltage to be settled is hard to become strictly the reference voltage Vref. It is therefore necessary for the capacitor (C1, Rb1) to be charged with the reference voltage Vref by closing the switch at an interval of a fixed period. On this occasion, the value to be settled is approximate to the reference voltage Vref, and hence a variation of the retaining voltage Vca during the retaining period decreases. Accordingly, as there is an elongated interval for changing the capacitor C1 with the reference voltage Vref, an intermittent period can be extended.

For example, a first electric potential is set to 2.4V, a second electric potential is set to 0V, and the reference voltage Vref is set to 1.2V. In this case, if enabled to output 1.2V in such a way that the voltage is divided ½ by the resistance component of the voltage retaining circuit 103, the retaining voltage Vca remains to be 1.2V at all times. If establishing a 1:1 in-series connection between the terminal 1 and the terminal 2 through the capacitor having the same capacity, the voltage can be divided ½. However, the parasitic resistance of the capacitor is hard to set to the strictly ½ voltage division, resulting in a convergence at a value approximate to 1.2V but other than 1.2V. Supposing that the electric potential to be converged is a DC voltage "1.1V", the variation of the voltage is as small as 0.1V.

Figure 2:
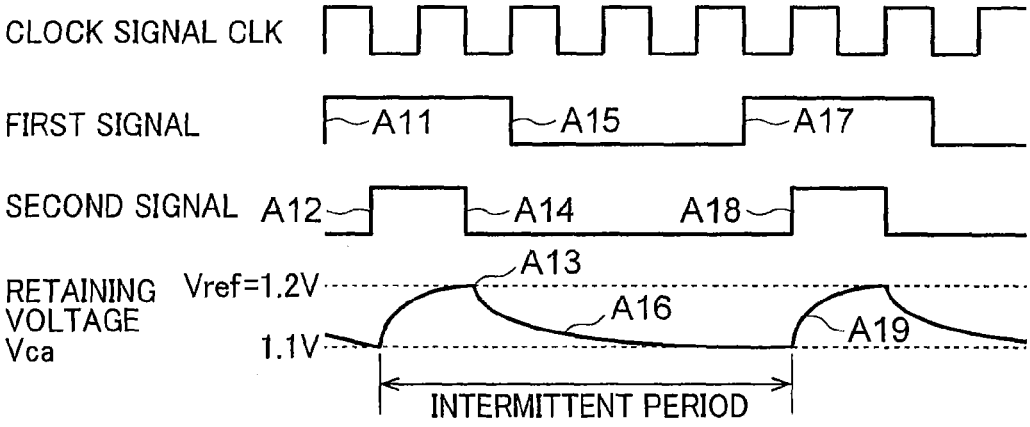
FIG. 2 is a diagram of an operation waveform according to the first embodiment.

FIG. 2 illustrates a diagram of an operation waveform in the first embodiment. The clock signal CLK is inputted to the controller 102, the first signal is switched ON at a certain timing (A11), and the reference voltage Vref is output from the reference voltage source 101. Next, the second signal is switched ON (A12), the switch 104 is closed, and the retaining voltage Vca becomes the same voltage as the reference voltage Vref (A13). An ON-period of the second signal corresponds to a charging period of the capacitor. Thereafter, the second signal is switched OFF (A14), and the first signal is also switched OFF (A15). The retaining voltage Vca is kept settling toward the DC voltage 1.1V determined by the voltage retaining circuit 103 (A16). After an elapse of the fixed period of time, the first and second signals are switched again ON (A17, A18), thereby returning the retaining voltage Vca to the reference voltage Vref (A19). The operations described above are repeated. The reference voltage generating apparatus decreases in power consumption because of the intermittent period being elongated.

Note that the time up to the settling changes when the capacity of the capacitor changes, and the time up to the settling time elongates if the capacity is large, but the charging time up to Vref also elongates. If the capacity is small, the time up to the settling time shortens. However, the charging time up to Vref also shortens. The capacitor having a proper capacity may be used. The capacity may also be controlled from the controller by use of the capacitor having a variable capacity.

Further, a period of time till the second signal is switched ON since the first signal has been switched ON may be predetermined. There may be predetermined a period of time till the first signal is switched OFF since the second signal has been switched OFF or a period of time till the first signal is switched OFF since the first signal has been switched ON. Another possible configuration is that the second signal and the first signal are switched OFF simultaneously.

Figure 3:
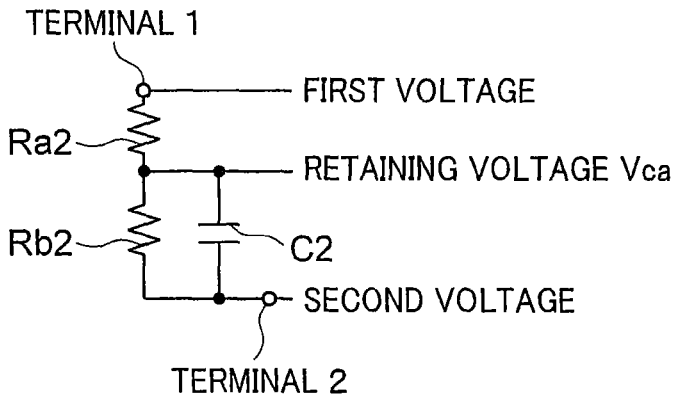
FIG. 3 is a diagram of a voltage retaining circuit according to the first embodiment.

FIG. 3 is a diagram of a voltage retaining circuit according to the first embodiment. This voltage retaining circuit has the same configuration as the voltage retaining circuit 103 has, in which the reference numerals and symbols are reallocated.

The first voltage is inputted from the terminal 1, the second voltage is inputted from the terminal 2, and the retaining voltage Vca is output. A resistance component Ra2 and a resistance component Rb2 are connected in series between the terminal 1 receiving the input of the first voltage and the terminal 2 receiving the input of the second voltage. A voltage divided by these resistances is the retaining voltage Vca. A capacitor C2 is connected in parallel with the resistance component (parasitic resistance) Rb2. Resistances of the resistance components Ra2, Rb2 are set so that the retaining voltage set by the resistance voltage division is equalized to the reference voltage Vref. After the capacitor C2 has been charged with the reference voltage Vref, the retaining voltage Vca goes on being settled, with the elapse of the time, to the DC voltage determined by the resistance voltage division.

Figure 4:
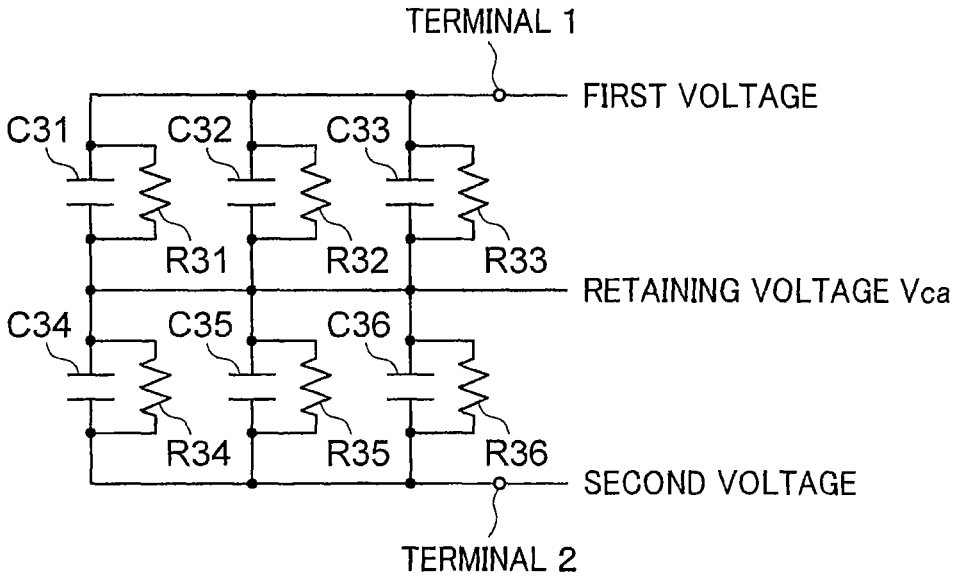
FIG. 4 is a diagram of the voltage retaining circuit according to the first embodiment.

FIG. 4 is diagram of the voltage retaining circuit according to the first embodiment.

Capacitors C31-C36 are connected between the terminal 1 to which the first voltage is inputted and the terminal 2 to which the second voltage is inputted. To be more specific, the capacitors C31, C32, C33 are connected in parallel in the first element circuit, and the capacitors C34, C35, C36 are connected in parallel in the second element circuit. Further, the capacitors C31, C32, C33 are connected in series to the capacitors C34, C35, C36 respectively. Parasitic resistances of the respective capacitors are designated by R31-R36. The parasitic resistances R31-R36 are added in parallel with the capacitors C31-C36. A DC voltage divided by these parasitic resistances is a destination voltage to which the retaining voltage Vca is settled. The DC voltage is set to become the reference voltage Vref by the parasitic resistances.

Note that the capacitors are connected in parallel in the first and second element circuits in the first embodiment and may also be connected in series or in series-parallel. The same connections are applied to FIGS. 5, 9 and 10, which will be illustrated later on.

Supposing that the first voltage is 2.4V and the second voltage is 0V, in order for the retaining voltage to become 1.2V, a total capacity of the capacitors C31-C33 is equalized to a total capacity of the capacitors C34-C36. In this case, the parasitic resistances pertaining thereto have a relationship of 1:1, resulting in becoming 1.2V. However, the parasitic resistance cannot strictly undergo the resistance voltage division due to a scatter, a temperature, process and modeling. Therefore, a settling destination value becomes a value slightly deviating from 1.2V. The voltage retaining circuit 103 is charged with the reference voltage Vref of the reference voltage source 101 by switching ON the switch 104 within the reference voltage generating apparatus. However, with the elapse of the time, the voltage approximates to the DC voltage determined by the voltage retaining circuit 103.

Figure 5:
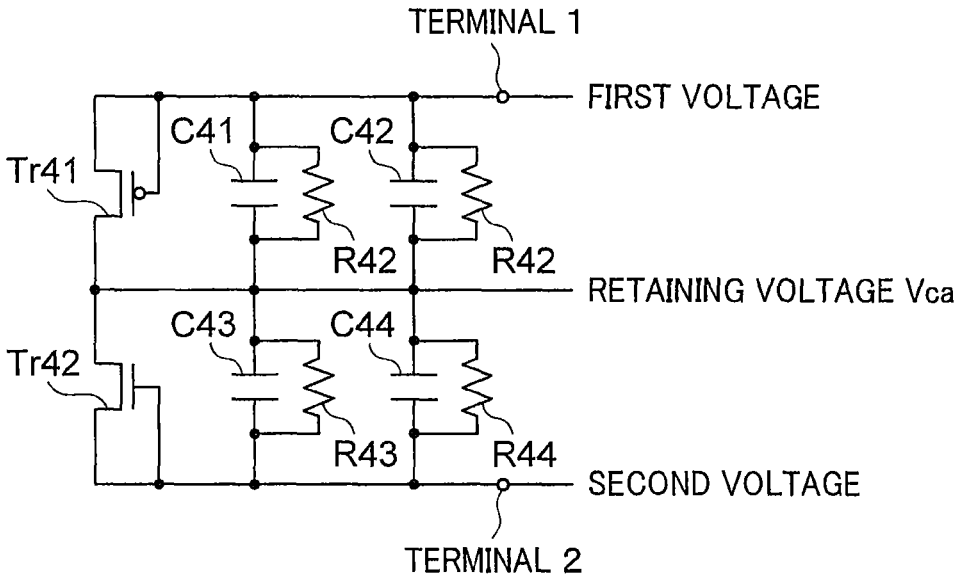
FIG. 5 is a diagram of the voltage retaining circuit according to the first embodiment.

FIG. 5 is a diagram of the voltage retaining circuit in the first embodiment. Capacitors C41-C44 are connected between the terminal 1 receiving the input of the first voltage and the terminal 2 receiving the input of the second voltage. To be more specific, the capacitors C41, C42 are connected in parallel, and the capacitors C43, C44 are connected in parallel. Further, the capacitors C41, C42 are connected in series to the capacitors C43, 44, respectively. Parasitic resistances of the respective capacitors are designated by R41-R44. The parasitic resistances R41-R44 are connected in parallel with the capacitors C41-C44.

Moreover, transistors Tr41-Tr42 are connected in series between the terminal 1 and the terminal 2. The transistor Tr41 is connected in parallel with the capacitors C41, C42. The transistor Tr42 is connected in parallel with the capacitors C43, C44. A gate terminal of the transistor Tr41 is electrically connected to the terminal 1. A gate terminal of the transistor Tr42 is electrically connected to the terminal 2. Through these connections, both of the transistors Tr41, Tr42 are kept OFF at all times. Therefore, the transistors Tr41, Tr42 correspond to resistances of about several GΩ-several TΩ. Thus, the transistor can be used as the resistance component of the voltage retaining circuit 103.

As described above, according to the first embodiment, the voltage retaining circuit can retain the voltage in a way that restrains the variations of the voltage of the output node of the voltage retaining circuit, and it is therefore feasible to set long the intermittent operating time of the reference voltage source and restrain the power consumption.

(Second Embodiment)

Figure 6:
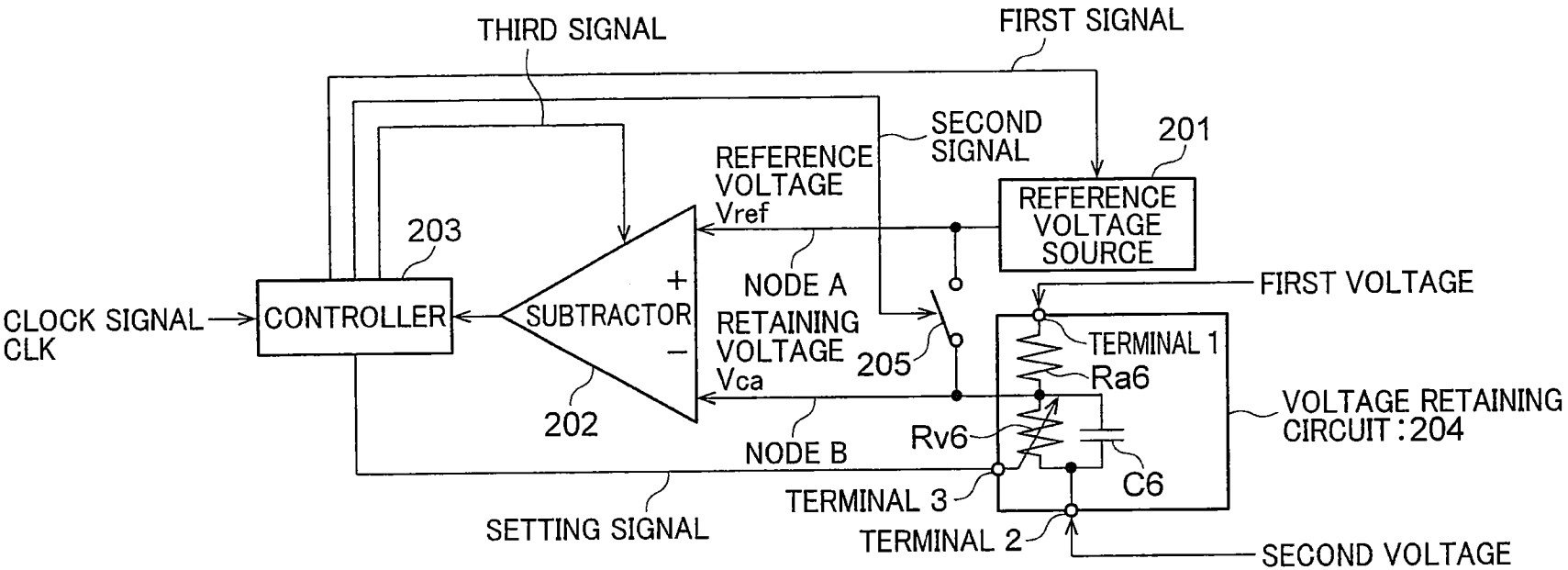
FIG. 6 is a diagram of a circuit configuration of the reference voltage generating apparatus according to a second embodiment.

FIG. 6 is a diagram of a circuit configuration of the reference voltage generating apparatus according to a second embodiment.

This reference voltage generating apparatus includes a reference voltage source 201, a subtractor 202, a controller 203, a voltage retaining circuit 204 and a switch 205. The reference voltage source 201 and the switch 205 are the same as those in the first embodiment.

The subtractor 202 receives an input of the retaining voltage Vca as an output of the voltage retaining circuit 204 and an input of the reference voltage Vref as an output of the reference voltage source 201. The subtractor 202 outputs an arithmetic result (Vref−Vca) given by subtracting Vca from Vref to the controller 203.

The voltage retaining circuit 204 has the terminal 1, the terminal 2 and a terminal 3. The first voltage is inputted from the terminal 1, the second voltage is inputted from the terminal 2, and the retaining voltage Vca is output to the node B. Resistance components Ra6, Rv6 are interposed in series between the terminal 1 and the terminal 2, and the retaining voltage Vca is output by a divided voltage. At least one capacitor component exists between the terminal 1 or the terminal 2 and the node B, thereby retaining the voltage Vca. In the example, a capacitor C6 exists between the terminal 2 and the node B.

Similarly to the first embodiment, the resistance component is exemplified such as the parasitic resistance of the capacitor and the resistance between the drain and the source of the off-transistor. The resistance component is as very large as several G-TΩ. A value of the resistance component Rv6 (e.g., the transistor) can be adjusted by a setting signal that is output from the controller 203. The setting signal is inputted to the terminal 3, whereby the value of the resistance component is changed. The value of the resistance component being thus changed, the voltage division ratio of the resistance component can be changed. When the voltage division ratio is changed, the settling destination of the retaining voltage Vca is changed.

The controller 203 receives an input of the clock signal CLK and an input of an arithmetic result of the subtractor 202. The controller 203 outputs a first signal to the reference voltage source 201, a second signal to the switch 205, a third signal to the subtractor 202 and the setting signal to the voltage retaining circuit 204. The controller 203 switches ON the first and third signals at, e.g., the timing of every fixed period while receiving the input of the clock signal CLK. The arithmetic circuit (subtractor) 202, upon receiving the input of the third signal, performs an arithmetic operation and outputs the arithmetic result. The controller 203 outputs the setting signal corresponding to the arithmetic result, and also outputs the second signal in an ON-state. The setting signal may have two types of values and may also have three or more types of values in the case of controlling the voltage division ratio more minutely. The value of the setting signal, which is to be output, may be determined corresponding to the value of the arithmetic result. The controller 203, after switching ON the second signal, switches OFF the second signal after a fixed period of time. Subsequently, the controller 203, after the fixed period of time since the second signal has been switched OFF, also switches OFF the first signal. The second signal and the first signal may be switched OFF simultaneously.

A negative feedback is applied by changing the voltage division ratio so that the reference voltage Vref is equalized to the retaining voltage Vca in accordance with the input of the arithmetic result of the subtractor 202. When a positive value is inputted to the controller 203 as the arithmetic result of the subtractor 202, the resistance voltage division ratio of the voltage retaining circuit 204 is changed to increase the retaining voltage Vca. When a negative value is inputted, the resistance voltage division ratio of the voltage retaining circuit 204 is changed to decrease the retaining voltage Vca.

Now, assuming a relationship of Vref>Vca, an output of the subtractor 202 is given by Vref−Vca>0, and a positive value is therefore output to the controller 203. The controller 203, upon an input of the positive value, increases the retaining voltage Vca by giving the voltage retaining circuit 204 a setting signal for increasing the value of the resistance component Rv6 between, e.g., the terminal 2 and the output node. Moreover, the controller 203 switches ON the switch and, after reaching an equation "Vca=Vref", switches OFF the switch. Consequently, the setting destination voltage determined by the resistance components connected in series to the terminal 1 and the terminal 2 of the voltage retaining circuit, approximates the reference voltage Vref. With a repetition of this negative feedback, the voltage of the settling destination becomes Vref.

Figure 7:
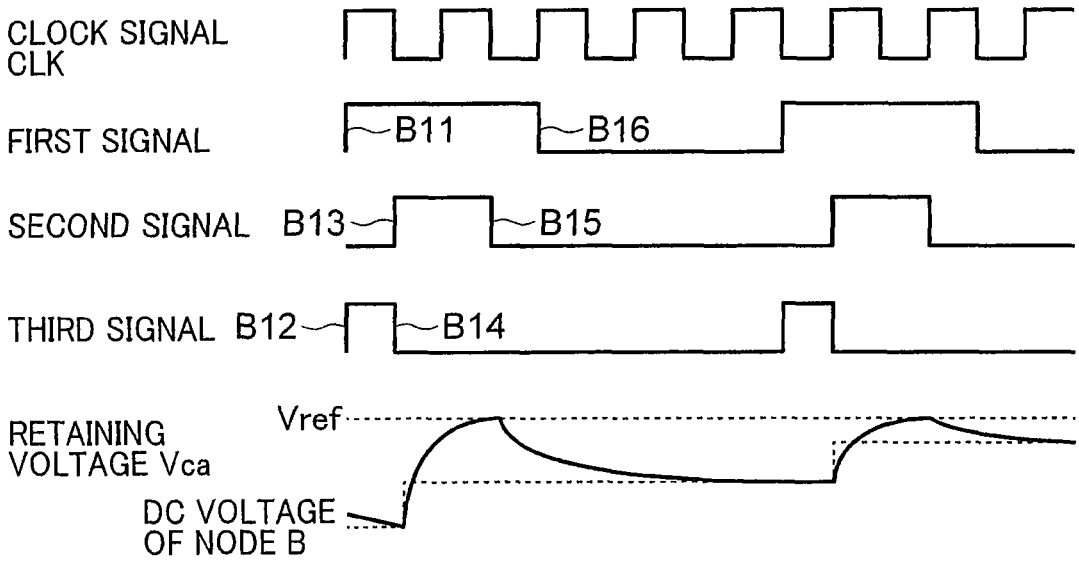
FIG. 7 is a diagram of an operation waveform according to the second embodiment.

FIG. 7 is a diagram of an operation waveform to describe the second embodiment.

With the clock signal CLK being inputted to the controller 203, to begin with, the first signal is switched ON (B11), and the reference voltage Vref is output. Further, the third signal is switched ON (B12), the subtractor 202 compares the reference voltage Vref with the retaining voltage Vca. The relationship being given by Vref−Vca>0, the controller 203 sets a resistance voltage division ratio to increase the retaining voltage Vca by outputting the setting signal to the voltage retaining circuit 204. Next, the second signal is switched ON (B13), and the voltage retaining circuit 204, with the resistance voltage division ratio being changed, is charged with the reference voltage Vref. Further, the third signal is switched OFF as the clock signal CLK is switched OFF (B14). The second signal is switched OFF after the fixed period of time since being switched ON (B15). Further, thereafter, the first signal is switched OFF (B16). With the repetition of this operation, the DC voltage of the retaining voltage Vca approximates the reference voltage Vref.

The resistance component of the voltage retaining circuit 204 is hard to be predicted in the actual circuit due to a process/power/temperature dependency, and varies also during the operation. It is therefore difficult to match in design. However, the reference voltage Vref with a small degree of the process/power/temperature dependency continues to be compared with the retaining voltage Vca, thereby enabling the retaining voltage Vca to be set to a voltage not depending on the process, the power and the temperature. When the settling destination voltage determined by the resistance component of the voltage retaining circuit 204 approximates the reference voltage Vref, there is a decreased period for the charge of the reference voltage Vref via the switch 205 from the reference voltage source 201. Hence, the power consumption can be reduced.

Figure 8:
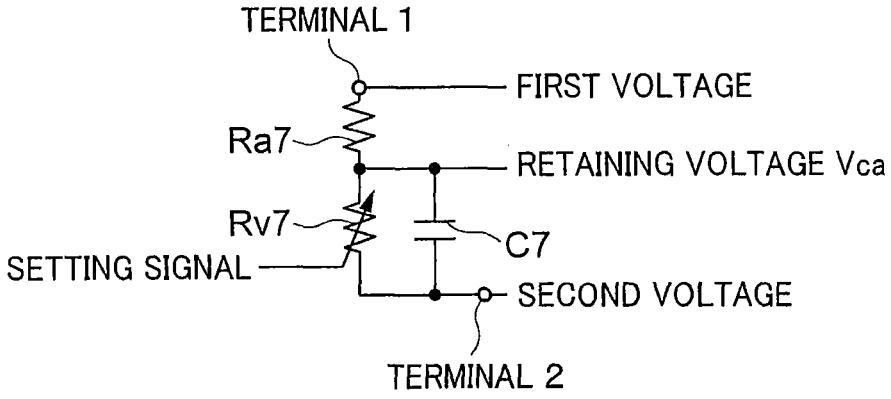
FIG. 8 is a diagram of the voltage retaining circuit according to the second embodiment.

FIG. 8 is a diagram of the voltage retaining circuit according to the second embodiment. This voltage retaining circuit has the same configuration as the voltage retaining circuit 103 illustrated in FIG. 6. However, the reference numerals and symbols are reallocated.

The first voltage is inputted to the terminal 1, and the second voltage is inputted to the terminal 2. A resistance Ra7 and a variable resistance Rv7 are connected in series to the terminal 1 and the terminal 2. A capacitor C7 is connected between the output node of the retaining voltage Vca and the terminal 2. A value of the variable resistance Rv7 is variable based on the setting signal that is output by the controller. Hence, the resistance voltage division ratio can be adjusted by the setting signal. A value of the retaining voltage Vca can be thereby changed.

Figure 9:
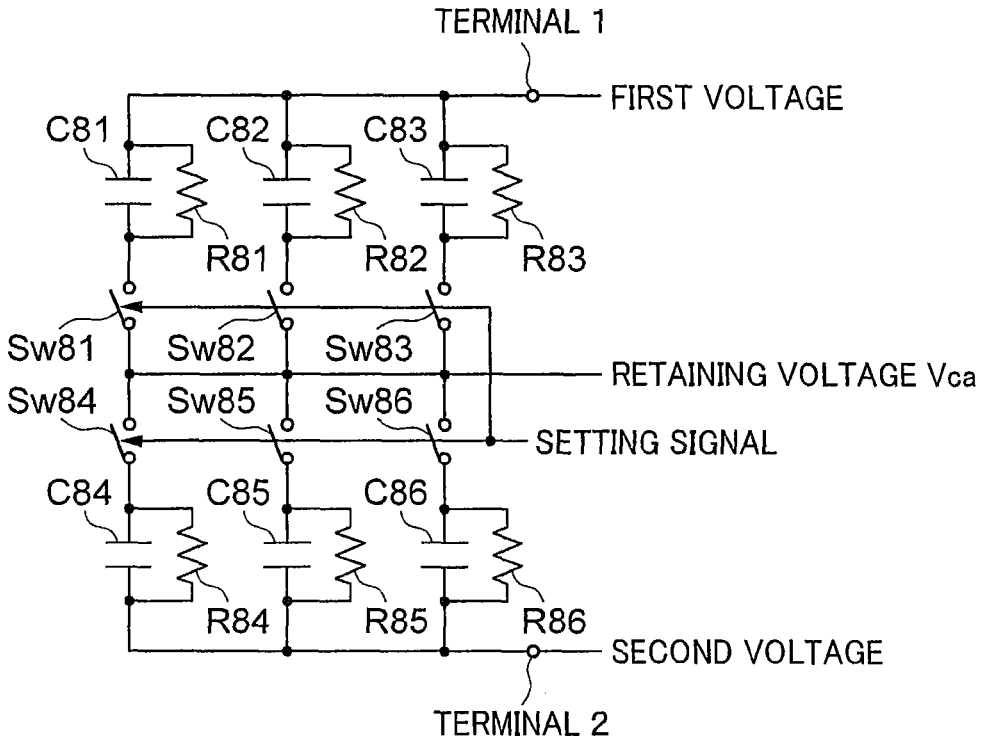
FIG. 9 is a diagram of the voltage retaining circuit according to the second embodiment.

FIG. 9 is a diagram of the voltage retaining circuit in the second embodiment. This configuration corresponds to a configuration if adding the switch between the output node B and each of the capacitors of the voltage retaining circuit according to the first embodiment illustrated in FIG. 4.

More specifically, capacitors C81, C82, C83, switches Sw81,Sw82, Sw83, switches Sw84,Sw85, Sw86 and capacitors C84, C85, C86 are connected in series between the terminal 1 receiving the input of the first voltage and the terminal receiving the input of the second voltage. Further, these in-series connections are established in parallel. Parasitic resistances of the capacitors are designated by R81, R82, R83, R84, R85, R86, respectively. A wire is connected to one terminals of the switches Sw81, Sw82, Sw83 and to one terminals of the switches Sw84, Sw85, Sw86 in common. A voltage of the wire corresponds to the retaining voltage Vca.

The ON/OFF states of the switches Sw81, Sw82, Sw83 and the switches Sw84, Sw85, Sw86 are controlled by the setting signals that are output from the controller. Each switch is switched ON/OFF by the setting signal, thereby enabling a change of the resistance voltage division ratio between the terminal 1 and the terminal 2. With this setting, the value of the retaining voltage Vca can be changed. Note that an ON/OFF pattern of the switch may be predetermined corresponding to the value of the arithmetic result of the subtractor.

Figure 10:
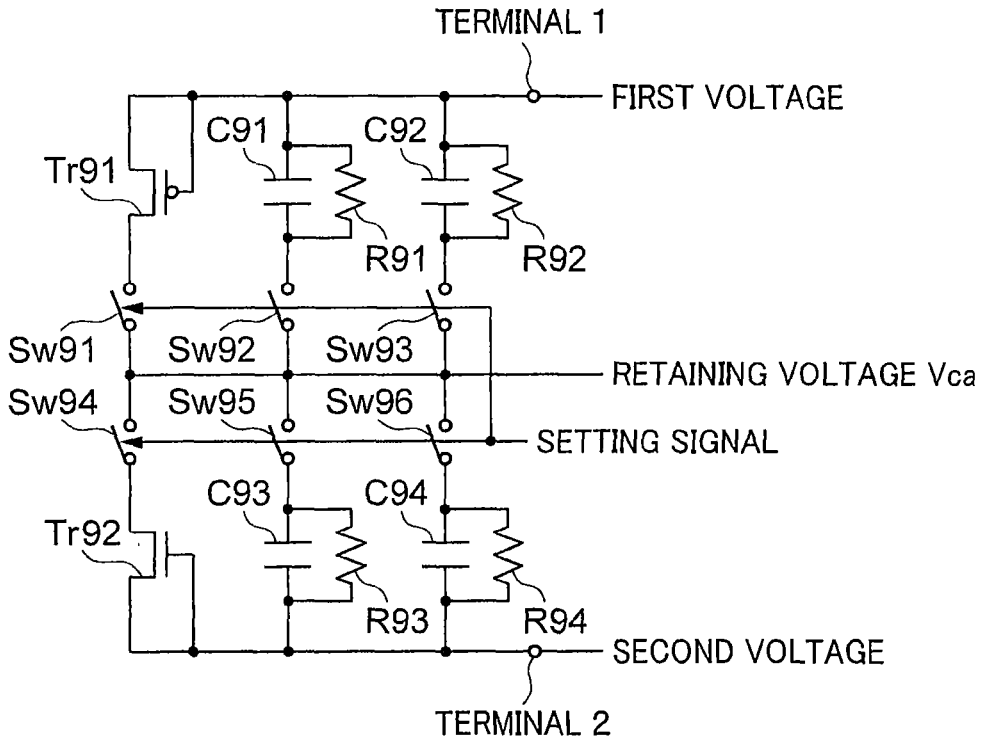
FIG. 10 is a diagram of the voltage retaining circuit according to the second embodiment.

FIG. 10 is a diagram of the voltage retaining circuit in the second embodiment. This configuration corresponds to a configuration in which the capacitor C81 and the resistance component R81 of the voltage retaining circuit shown in FIG. 9 are replaced with a transistor Tr91, and the capacitor C84 and the resistance component R84 of the voltage retaining circuit in FIG. 9 are replaced with a transistor Tr92. Other components are the same as those in FIG. 9. Namely, capacitors C91, C92, C93, C94 in FIG. 10 correspond to the capacitors C82, C83, C85, C86 in FIG. 9. The parasitic resistances R91, R92, R93, R94 of the capacitors in FIG. 10 correspond to R82, R83, R85, R86 in FIG. 9. Each switch is switched ON/OFF by the setting signal, thereby enabling the change of the resistance voltage division ratio between the first voltage and the second voltage. With this setting, the value of the retaining voltage Vca can be changed.

As discussed above, according to the second embodiment, the retaining voltage having the same voltage level as the reference voltage can be stably supplied even when the resistance component varies due to a scatter of the temperature etc. by applying the negative feedback to the resistance component of the voltage retaining circuit so that the retaining voltage becomes coincident with the reference voltage.

(Third Embodiment)

Figure 11:
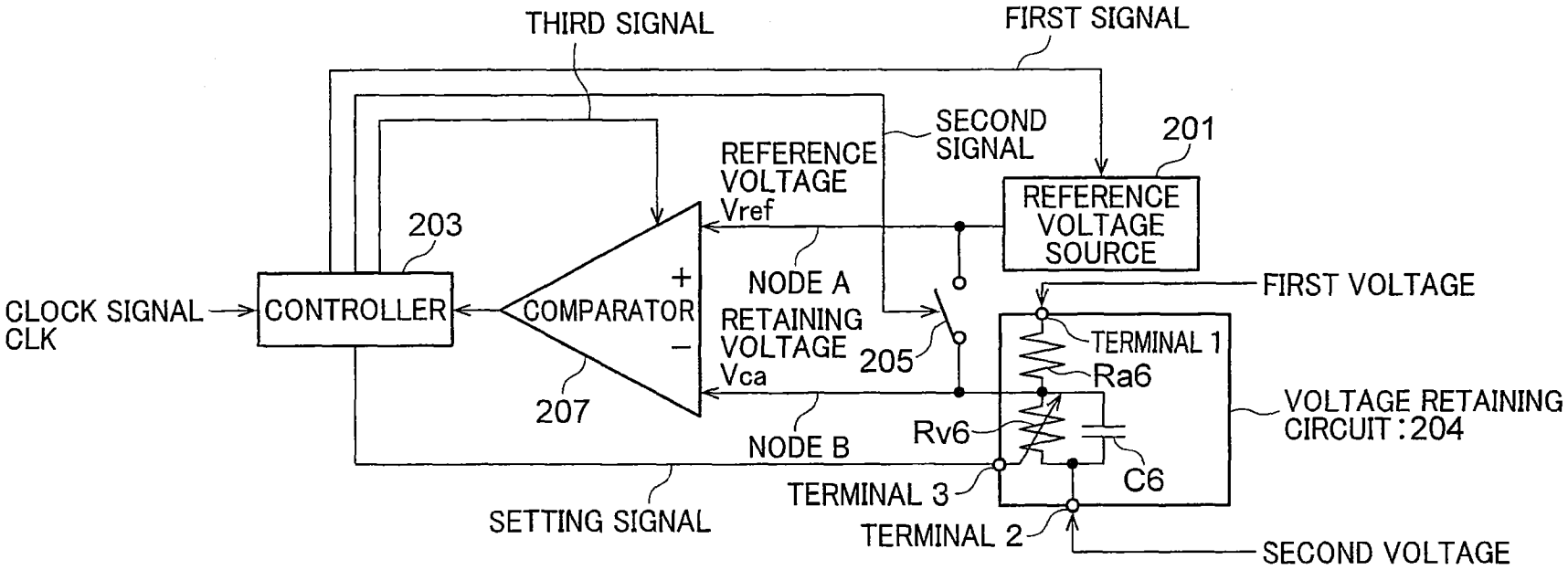
FIG. 11 is a diagram of a circuit configuration of the reference voltage generating apparatus according to a third embodiment.

FIG. 11 is a diagram of a circuit configuration of the reference voltage generating apparatus according to a third embodiment. The subtractor (see FIG. 6) in the second embodiment is replaced with a comparator (in the third embodiment). The same components having the same nomenclatures as those in FIG. 6 are marked with the same numerals and symbols, and the repetitive descriptions are omitted except extended or changed processes.

The comparator 207 makes a comparison in magnitude between the input voltages, and outputs a result of this comparison as a binary value to the controller 203. In this example, the comparator 207 compares the reference voltage Vref with the retaining voltage Vca. The comparator 207 outputs "1" (high level) when Vref>Vca and outputs "0" (low level) when Vref<Vca. Alternatively, a relationship between the magnitude of the voltage and the output level may also be reversed to the above.

The controller 203 changes the voltage division ratio of the resistance component in the voltage retaining circuit 204 to decrease a difference between the reference voltage Vref and the retaining voltage Vca. When Vref>Vca, the resistance voltage division ratio is changed over to increase the retaining voltage Vca of the voltage retaining circuit 204. When Vref<Vca, the resistance voltage division ratio is changed over to decrease the retaining voltage Vca of the voltage retaining circuit 204. The input to the controller 203 changes from a multi-value to a binary value by replacing the subtractor with the comparator 207. Therefore, such an effect is yielded as to simplify the configuration of the controller 203. Namely, the subtractor outputs "Vref−Vca" as the multi-value. However, the result of the comparator is the binary value. The circuit configuration of the controller is therefore simplified.

(Fourth Embodiment)

Figure 12:
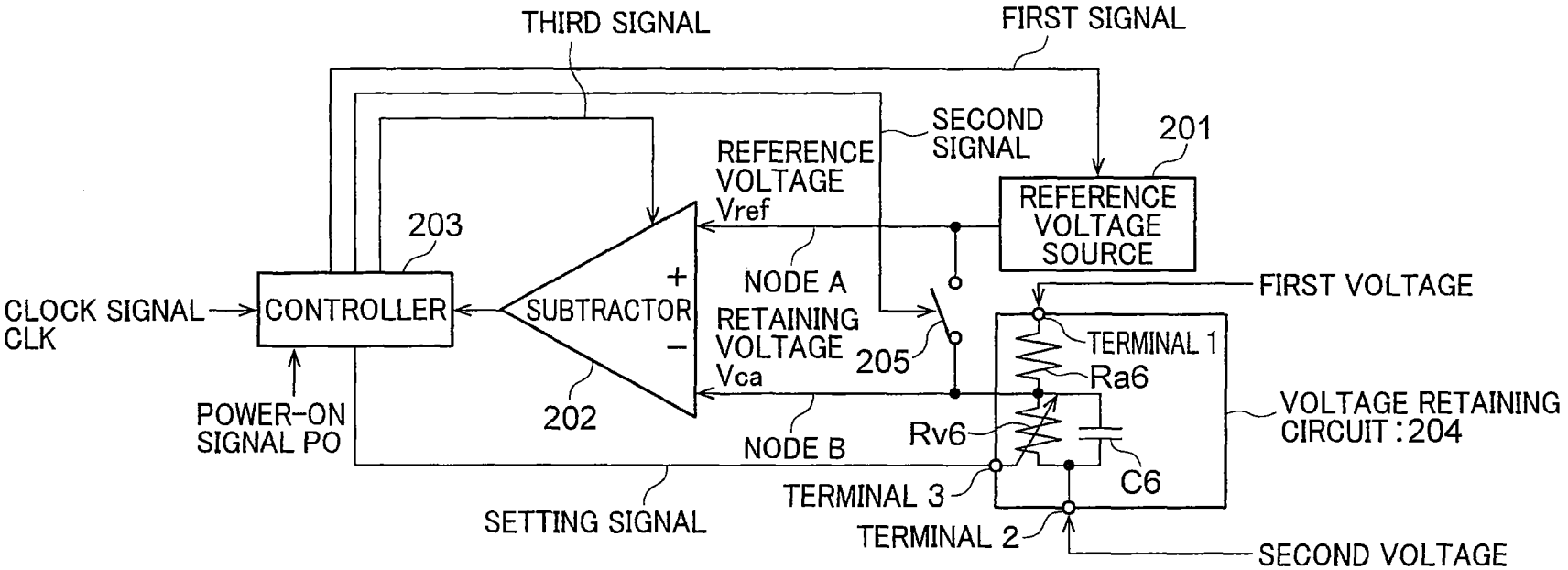
FIG. 12 is a diagram of a circuit configuration of the reference voltage generating apparatus according to a fourth embodiment.

FIG. 12 is a diagram of a circuit configuration of the reference voltage generating apparatus according to a fourth embodiment. The same components having the same nomenclatures as those in FIG. 6 are marked with the same numerals and symbols, and the repetitive descriptions are omitted except extended or changed processes.

A different point in the fourth embodiment is that a power-ON signal PO is inputted to the controller 203 in the second embodiment (see FIG. 6). The controller 203 receives this power-ON signal, thereby charging the voltage retaining circuit 204 with the reference voltage Vref by switching ON the first and second signals even when the clock signal CLK is not inputted. The controller 203, after the clock signal has been inputted once or a plural number of times, performs the operation of the second embodiment. To be specific, the controller 203 performs the operation after confirming that the clock signal is stably supplied. The stable operation can be thereby attained.

Thus, the input of the power-ON signal enables the retaining voltage to be output in the way of its being equalized in voltage level to the reference voltage even when the clock signal is not inputted.

(Fifth Embodiment)

Figure 13:
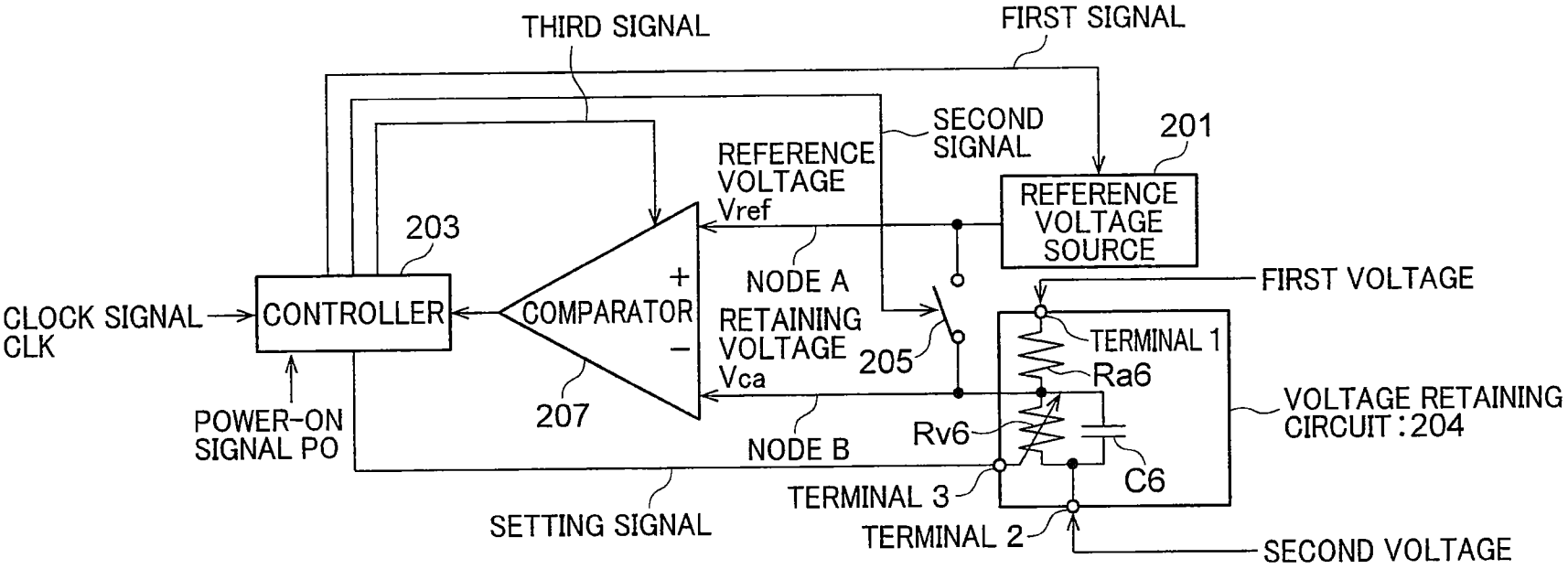
FIG. 13 is a diagram of a circuit configuration of the reference voltage generating apparatus according to a fifth embodiment.

FIG. 13 is a diagram of a circuit configuration of the reference voltage generating apparatus according to a fifth embodiment. The same components having the same nomenclatures as those in FIG. 11 are marked with the same numerals and symbols, and the repetitive descriptions are omitted except extended or changed processes.

A different point in the fifth embodiment is that the power-ON signal PO is inputted to the controller in the third embodiment (see FIG. 11). The controller 203 receives this power-ON signal, thereby charging the voltage retaining circuit 204 with the reference voltage Vref by switching ON the first and second signals even when the clock signal CLK is not inputted. The controller 203, after the clock signal has been inputted once or the plural number of times, performs the operation of the third embodiment. To be specific, the controller 203 performs the operation of the third embodiment after confirming that the clock signal is stably supplied. The stable operation can be thereby attained.

Thus, the input of the power-ON signal enables the retaining voltage to be output in the way of its being equalized in voltage level to the reference voltage even when the clock signal is not inputted.

(Sixth Embodiment)

Figure 14:
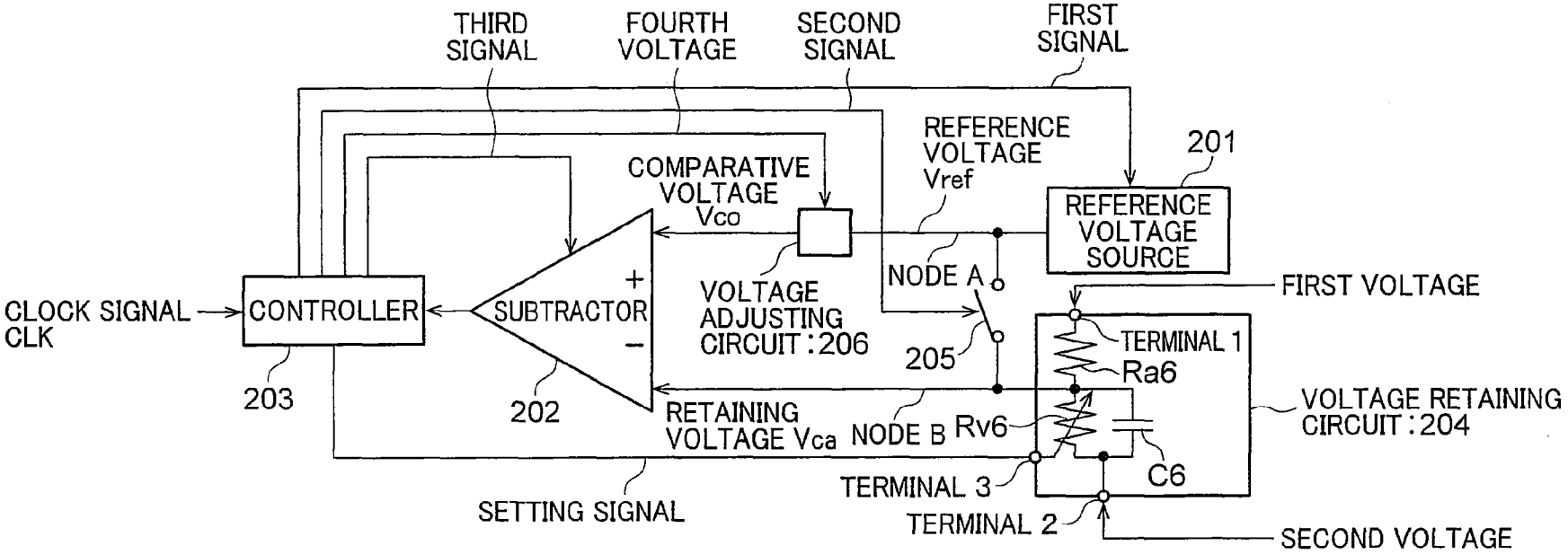
FIG. 14 is a diagram of a circuit configuration of the reference voltage generating apparatus according to a sixth embodiment.

FIG. 14 is a diagram of a circuit configuration of the reference voltage generating apparatus according to a sixth embodiment. The same components having the same nomenclatures as those in FIG. 6 are marked with the same numerals and symbols, and the repetitive descriptions are omitted except extended or changed processes.

A different point in the sixth embodiment is that a voltage adjusting circuit 206 is connected between the subtractor 202 and the reference voltage source 201 in the second embodiment (see FIG. 6). The controller 203 receives an input of the clock signal CLK and an input of the arithmetic result of the subtractor 202. The controller 203 outputs the first, second, third and fourth signals. The controller 203, after switching ON the first signal, subsequently switches ON the fourth signal. The voltage adjusting circuit 206, upon receiving an input of the fourth signal in the ON-state, generates a comparative voltage Vco on the basis of the reference voltage Vref inputted from the reference voltage source 201. The comparative voltage Vco has a magnitude (voltage level) different from the reference voltage Vref. The comparative voltage Vco is inputted to the subtractor 202. A voltage to be compared by the subtractor 202 is thereby changed from Vref to Vco.

A method, by which the voltage adjusting circuit 206 generates the comparative voltage Vco from the reference voltage Vref, is exemplified by the following methods. One of these methods is a method of generating the comparative voltage Vco by adding a DC offset voltage Vos to the reference voltage Vref such as Vco=Vref+Vos. There is also a method of generating the comparative voltage Vco by amplifying the reference voltage Vref with a gain $\alpha$ such as Vco=$\alpha$×Vref. Values of Vos and $\alpha$ can be arbitrarily set. Further, the comparative voltage Vco may be generated in conjunction with Vos and $\alpha$ such as Vco=$\alpha$×Vref+Vos. The comparative voltage Vco can be set larger or smaller than the reference voltage Vref in accordance with values of Vos and $\alpha$.

Thus, the voltage to be compared by the subtractor 202 is changed from Vref to Vco, thereby enabling the value of the retaining voltage Vca of the voltage retaining circuit 204 to be set to an arbitrary value exclusive of the reference voltage Vref. Moreover, a transition direction of the retaining voltage Vca transitioning to the settling voltage (DC voltage of the node B) from the reference voltage Vref, can be limited to an incrementing or decrementing direction.

For example, supposing Vco=Vref×1.01, with the comparative voltage Vco being set to a value higher than the reference voltage Vref, the settling voltage of the retaining voltage Vca becomes higher than the reference voltage Vref. Hence, the retaining voltage Vca can be compensated to increment from the reference voltage Vref. While on the other hand, supposing Vco=Vref×0.99, with the comparative voltage Vco being set to a value lower than the reference voltage Vref, the settling voltage of the retaining voltage Vca becomes lower than the reference voltage Vref. Therefore, the retaining voltage Vca can be compensated to decrement from the reference voltage Vref.

Figure 15:
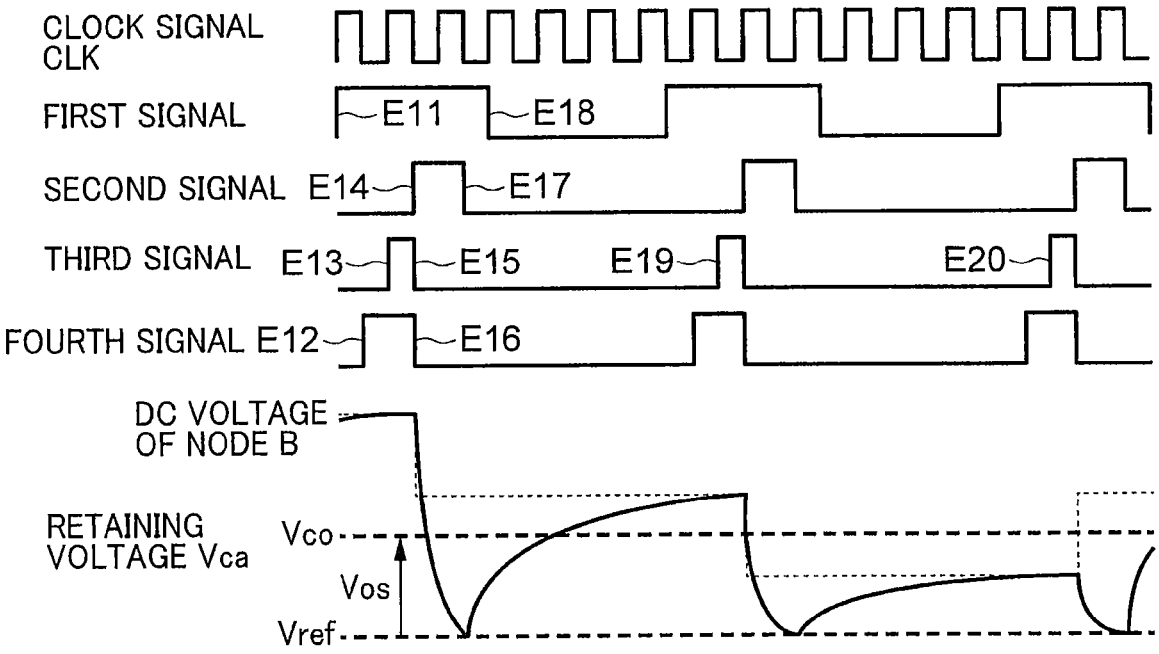
FIG. 15 is a diagram of an operation waveform according to the sixth embodiment.

FIG. 15 is a diagram of an operation waveform to explain the sixth embodiment.

The controller 203 receives the input of the clock signal CLK, and the first signal is switched ON at a certain timing at every fixed cycle (E11). The reference voltage source 201 outputs the reference voltage Vref while the first signal is kept ON. Next, the fourth signal is switched ON (E12), whereby the voltage adjusting circuit 206 generates the comparative voltage Vco from the reference voltage Vref and outputs the generated comparative voltage Vco to the subtractor 202. In this example, the voltage adjusting circuit 206 adds the DC offset voltage Vos to the reference voltage Vref to establish a relationship such as Vco=Vref+Vos, thus generating the comparative voltage Vco. Next, the third signal is switched ON (E13). The subtractor 202 compares the comparative voltage Vco with the retaining voltage Vca (a curve of solid line given lowermost in FIG. 15), and outputs an arithmetic result of Vco−Vca. Herein, a value of the arithmetic result is expressed by Vco−Vca<0. Therefore, the controller 203 sets the resistance voltage division ratio to decrease the retaining voltage Vca by outputting the setting signal to the voltage retaining circuit 204. The DC voltage (depicted by a polygonal dashed line given lowermost in FIG. 15) of the node B is thereby decreased. Next, the second signal is switched ON (E14). Then, the voltage retaining circuit 204 with the resistance voltage division ratio being changed is charged with the reference voltage Vref. When the second signal is switched ON, the third and fourth signals are switched OFF (E15, E16). The second signal is switched OFF after the fixed period of time since being switched ON (E17). Further, thereafter, the first signal is switched OFF (E18).

Next, when the third signal is switched ON (E19), because of the relationship being "Vco−Vca<0", the controller 203 sets the resistance voltage division ratio to decrease the retaining voltage Vca. With this setting, the DC voltage of the node B is further decreased (becomes lower than Vco). Moreover, when the third signal is next switched ON (E20), because of the relationship being "Vco−Vca>0", the controller 203 sets the resistance voltage division ratio to increase the retaining voltage Vca. With a repetition of this operation, the settling voltage of the retaining voltage Vca approximates the comparative voltage Vco.

(Seventh Embodiment)

Figure 16:
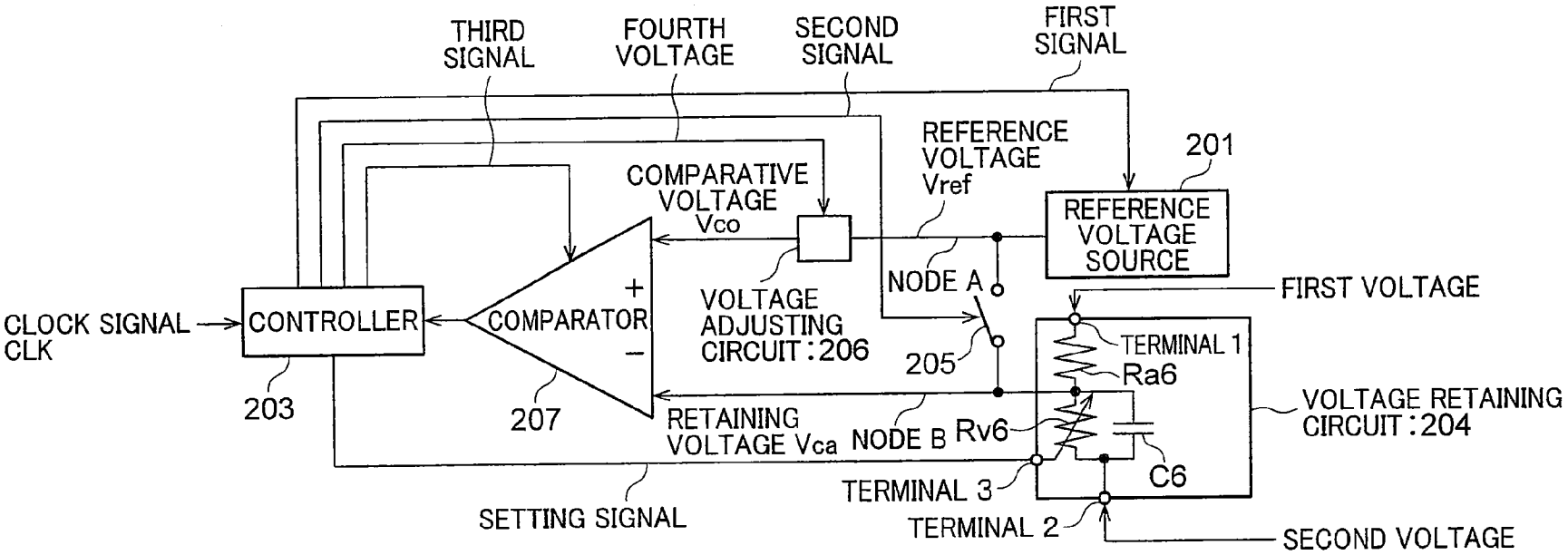
FIG. 16 is a diagram of a circuit configuration of the reference voltage generating apparatus according to a seventh embodiment.

FIG. 16 is a diagram of a circuit configuration of the reference voltage generating apparatus according to a seventh embodiment. The seventh embodiment is configured to replace the subtractor (see FIG. 14) of the sixth embodiment with a comparator. The same components having the same nomenclatures as those in FIG. 14 are marked with the same numerals and symbols, and the repetitive descriptions are omitted except extended or changed processes.

The comparator 207 makes a comparison in magnitude between the input voltages and outputs a result of this comparison as a binary value to the controller 203. In this example, the comparator 207 compares the comparative voltage Vco with the retaining voltage Vca. The comparator 207 outputs "1" (high level) when Vco>Vca and outputs "0" (low level) when Vco<Vca. Alternatively, a relationship between the magnitude of the voltage and the output level may also be reversed to the above.

The controller 203 changes the voltage division ratio of the resistance component in the voltage retaining circuit 204 to decrease a difference between the comparative voltage Vco and the retaining voltage Vca. When Vco>Vca, the resistance voltage division ratio is changed over to increase the retaining voltage Vca of the voltage retaining circuit 204. When Vco<Vca, the resistance voltage division ratio is changed over to decrease the retaining voltage Vca of the voltage retaining circuit 204. The input to the controller 203 changes from a multi-value to a binary value by replacing the subtractor with the comparator 207. Therefore, such an effect is yielded as to simplify the configuration of the controller 203. Namely, the subtractor outputs "Vref−Vca" as the multi-value. However, the result of the comparator is the binary value. The circuit configuration of the controller is therefore simplified.

(Eighth Embodiment)

Figure 17:
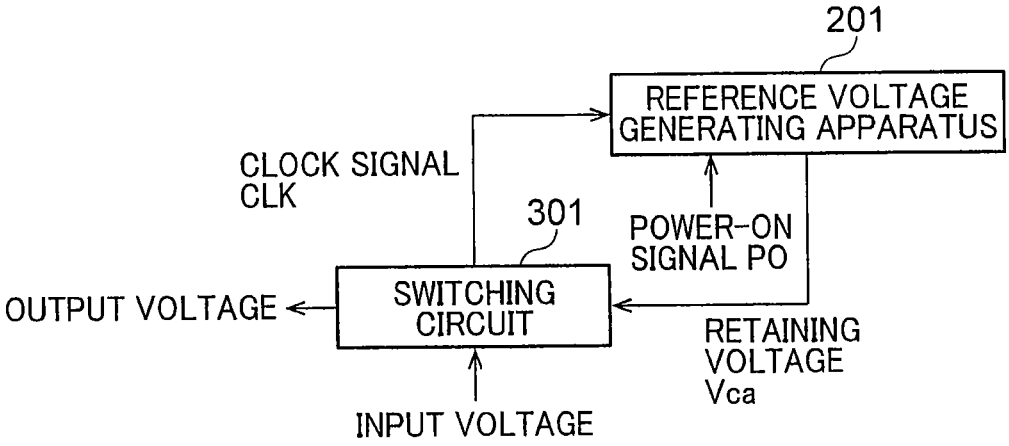
FIG. 17 is a diagram of a circuit configuration of a switching power apparatus using the reference voltage generating apparatus according to the eighth or fifth embodiment.

FIG. 17 is a diagram of a circuit configuration of a switching power apparatus using the reference voltage generating apparatus in the fourth or fifth embodiment.

The switching power apparatus includes a switching circuit 301 and a reference voltage generating apparatus 302 to which the fourth or fifth embodiment is applied. The switching power apparatus receives an input of the input voltage, and outputs a voltage proportional to the retaining voltage Vca as an output voltage.

The switching circuit 301 receives the input of the input voltage and an input of the retaining voltage Vca as the output from the reference voltage generating apparatus 302. Then, the switching circuit 301 outputs the clock signal CLK to the reference voltage generating apparatus 302, thereby outputting the output voltage.

In the switching circuit 301, at least one switch is interposed between the output voltage and the input voltage. The switching circuit 301 compares the retaining voltage Vca with the output voltage. The switching circuit 301 adjusts the output voltage by switching over the switch so that the output voltage becomes a voltage proportional to the retaining voltage Vca. Synchronizing with this switch, the clock signal CLK is inputted to the reference voltage generating apparatus 302.

When starting an operation of this switching power apparatus, at first the power-ON signal PO is inputted to the reference voltage generating apparatus 302. This power-ON signal PO being inputted, the retaining voltage Vca is output from the reference voltage generating apparatus 302 even when the clock signal CLK is not inputted thereto. The retaining voltage Vca and the input voltage are inputted to the switching circuit 301. The switching circuit 301 switches over the output voltage through an ON/OFF operation of a switch provided within the switching circuit 301 to have a value proportional to the retaining voltage Vca. The reference voltage generating apparatus 302 receives the input of the clock signal CLK synchronizing with the switch of the switching circuit 301. Then, the reference voltage generating apparatus 302 performs the operation of the reference voltage generating apparatus according to the fourth or fifth embodiment.

The switching power apparatus requires the reference voltage generating apparatus exhibiting low power consumption for attaining high efficiency. The switching power apparatus includes the reference voltage generating apparatus according to the fourth or fifth embodiment, thereby enabling the high efficiency to be attained.

Specifically, the clock signal synchronizing with the switching cycle is given (output) to the reference voltage generating apparatus 302 according to the eighth embodiment when using the switching power apparatus. With this contrivance, a new clock source is not required, and hence there is eliminated a necessity for the new clock source to output the retaining voltage.

Further, the reference voltage generating apparatus 302 according to the eighth embodiment is used for the switching power apparatus, which yields an effect of attaining the high efficiency especially when a low-load current (equal to or lower than 100 μA) flows. When starting the operation, the retaining voltage is 0V, and the clock signal is not generated. Therefore, the power-ON signal is needed for setting this voltage to the reference voltage Vref.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

The invention claimed is:

1. A reference voltage generating apparatus comprising:

a reference voltage source to generate a reference voltage;

a voltage retaining circuit that comprises a first element circuit and a second element circuit, the voltage retaining circuit outputting a voltage of a connection node between a first terminal of the first element circuit and a second terminal of the second element circuit;

a switch connected between the connection node and the reference voltage source; and a controller to control the reference voltage source and the switch, wherein the first element circuit includes at least a resistance component and the first element circuit is supplied with a first voltage at a third terminal, wherein the second element circuit includes a resistance component and a capacity component and the second element circuit is supplied with a second voltage at a fourth terminal.

2. The apparatus according to claim 1, wherein the controller switches ON the switch during at least a part of a period during which the reference voltage source generates the reference voltage.

3. The apparatus according to claim 1, wherein the reference voltage is a voltage between the first voltage and the second voltage.

4. The apparatus according to claim 1, further comprising an arithmetic circuit to calculate a difference between the reference voltage generated by the reference voltage source and an output voltage of the voltage retaining circuit, wherein the controller controls a value of the resistance component included in at least any one of the first element circuit and the second element circuit in accordance with the difference.

5. The apparatus according to claim 4, further comprising a voltage adjusting circuit to generate a comparative voltage having a voltage level different from the reference voltage on the basis of the reference voltage generated by the reference voltage source, wherein the arithmetic circuit calculates a difference between the comparative voltage and the output voltage of the voltage retaining circuit, and the controller controls a value of the resistance component included in at least any one of the first element circuit and the second element circuit in accordance with the difference.

6. The apparatus according to claim 4, wherein the controller controls the value of the resistance component in accordance with whether the difference is a positive value or a negative value.

7. The apparatus according to claim 4, wherein the controller controls the value of the resistance component included in at least any one of the first element circuit and the second element circuit so as to increase the output voltage when the reference voltage is larger than the output voltage, and controls the value of the resistance component included in at least any one of the first element circuit and the second element circuit so as to decrease the output voltage when the reference voltage is smaller than the output voltage.

8. The apparatus according to claim 5, wherein the controller controls the value of the resistance component included in at least any one of the first element circuit and the second element circuit so as to increase the output voltage when the comparative voltage is larger than the output voltage, and controls the value of the resistance component included in at least any one of the first element circuit and the second element circuit so as to decrease the output voltage when the comparative voltage is smaller than the output voltage.

9. The apparatus according to claim 1, further comprising a comparator to compare the reference voltage generated by the reference voltage source with an output voltage of the voltage retaining circuit, wherein the controller controls a value of the resistance component included in at least any one of the first element circuit and the second element circuit in accordance with a comparative result of the comparator.

10. The apparatus according to claim 9, wherein the controller controls the value of the resistance component included in at least any one of the first element circuit and the second element circuit so as to increase the output voltage when the reference voltage is larger than the output voltage, and controls the value of the resistance component included in at least any one of the first element circuit and the second element circuit so as to decrease the output voltage when the reference voltage is smaller than the output voltage.

11. The apparatus according to claim 9, further comprising a voltage adjusting circuit to generate a comparative voltage having a voltage level different from the reference voltage on the basis of the reference voltage generated by the reference voltage source, wherein the comparator compares the comparative voltage with the output voltage of the voltage retaining circuit, and the controller controls a value of the resistance component included in at least any one of the first element circuit and the second element circuit in accordance with a comparative result of the comparator.

12. The apparatus according to claim 11, wherein the controller controls the value of the resistance component included in at least any one of the first element circuit and the second element circuit so as to increase the output voltage when the comparative voltage is larger than the output voltage, and controls the value of the resistance component included in at least any one of the first element circuit and the second element circuit so as to decrease the output voltage when the comparative voltage is smaller than the output voltage.

13. The apparatus according to claim 4, wherein the controller controls the reference voltage source, the switch, the arithmetic circuit and the resistance component in accordance with a clock signal inputted from outside.

14. The apparatus according to claim 9, wherein the controller controls the reference voltage source, the switch, the comparator and the resistance component included in at least any one of the first element circuit and the second element circuit in accordance with a clock signal input from outside.

15. The apparatus according to claim 13, wherein the controller causes the reference voltage source to generate the reference voltage and switches ON the switch when a power-ON signal is inputted from outside in a state which the clock signal is not inputted.

16. The apparatus according to claim 1, wherein the first element circuit includes one or more elements that are connected in parallel, in series or in series-parallel, the elements each being either a capacitor element or the resistance element.

17. The apparatus according to claim 1, wherein the second element circuit includes one or more elements that are connected in parallel, in series or in series-parallel, the elements each being either the capacity component or the resistance component, and at least one of the elements being the capacity component.

18. The apparatus according to claim 16, wherein the resistance element is a transistor.

19. A switching power apparatus comprising:

the reference voltage generating apparatus according to claim 15; and a switching circuit performs a switching operation according to the output voltage output from the reference voltage generating apparatus to generate a first output voltage and a clock signal synchronizing with the switching operation, wherein the controller of the reference voltage generating apparatus receives the clock signal generated by the switching circuit.

20. A reference voltage generating apparatus comprising:

a reference voltage source to generate a reference voltage;

a voltage retaining circuit comprising a first resistance component, a second resistance component and a capacity component, wherein the first resistance component is connected to the second resistance component in series, the capacity component is connected to the second resistance component in parallel, and the voltage retaining circuit outputs a voltage of a connection node between a first terminal of the first resistance component and a second terminal of the second resistance component;

a switch connected between the connection node and the reference voltage source; and a controller to control the reference voltage source and the switch, wherein the first resistance component is supplied with a first voltage at a third terminal, wherein the second resistance component is supplied with a second voltage at a fourth terminal.

* * * * *